US006155337A

United States Patent [19]

Rosengarten et al.

[11] Patent Number: 6,155,337

[45] Date of Patent: Dec. 5, 2000

[54] TUBULAR HEAT EXCHANGER FOR CONNECTION DOWNSTREAM OF A THERMAL-CRACKING INSTALLATION

[75] Inventors: Bernhard Rosengarten, Marl; Juergen Paul, Dorsten, both of Germany

[73] Assignee: Ruhr Oel GmbH, Gelsenkirchen, Germany

[21] Appl. No.: 09/029,264

[22] PCT Filed: Sep. 14, 1998

[86] PCT No.: PCT/EP96/04045

§ 371 Date: May 15, 1998

§ 102(e) Date: May 15, 1998

[87] PCT Pub. No.: WO97/11330

PCT Pub. Date: Mar. 27, 1997

[30] Foreign Application Priority Data

Sep. 20, 1995 [DE] Germany ..... 195 34 823

[51] Int. Cl.[7] ..... F28F 13/18

[52] U.S. Cl. ..... 165/133; 29/890.038

[58] Field of Search ..... 165/158, 133, 165/906, 134.1; 427/230, 422, 423; 428/148, 143, 144; 29/890.038

[56] References Cited

U.S. PATENT DOCUMENTS

| | | | |
|---|---|---|---|
| 3,017,696 | 1/1962 | Vaaler | 165/133 |
| 3,448,804 | 6/1969 | Kreiselmaier | 165/133 |
| 3,751,295 | 8/1973 | Blumenthal et al. | 165/133 |
| 3,990,862 | 11/1976 | Dahl et al. | 165/133 |
| 4,520,866 | 6/1985 | Nakajima e tal. | 165/133 |
| 4,753,849 | 6/1988 | Zohler | 165/133 |
| 4,795,662 | 1/1989 | Kreiseimaier | 165/133 |
| 4,852,644 | 8/1989 | Schiemenat et al. | 165/133 |
| 4,899,813 | 2/1990 | Menicatti et al. | 165/133 |
| 5,141,049 | 8/1992 | Larson et al. | 165/133 |
| 5,246,063 | 9/1993 | Fix et al. | 165/133 |
| 5,518,066 | 5/1996 | Francis et al. | 165/133 |
| 5,699,852 | 12/1997 | Park et al. | 165/133 |

*Primary Examiner*—Ira S. Lazarus
*Assistant Examiner*—Terrell McKinnon
*Attorney, Agent, or Firm*—Oblon, Spivak, McClelland, Maier & Neustadt, P.C.

[57] ABSTRACT

Described is a heat exchanger comprising a nest of heat-exchange tubes held between two end plates, the heat exchanger being designed for connection downstream of a thermal-cracking installation. In order to reduce erosion of the base plate, the plate at the input end is coated on the side facing the oncoming gas with an erosion-resistant, fireproof coating of a chemically bound compound, leaving clear the apertures for the heat-exchange tubes.

9 Claims, 2 Drawing Sheets

TUBULAR HEAT EXCHANGER FOR CONNECTION DOWNSTREAM OF A THERMAL-CRACKING INSTALLATION

BACKGROUND OF THE INVENTION

1. Field of the Invention

The invention concerns a bundle of heat exchanger tubes connected downstream of a thermal cracking installation with a bundle of heat exchanger tubes held between two tube plates, a method to coat a tube plate as well as the application of a packing material.

Such bundles of heat exchanger tubes are used, for example, in ethylene plants for the production of ethylene by thermal cracking on the upstream side of a transfer line of a cracking oven and described as cracked gas coolers.

2. Description of the Background

Cracked gas coolers must satisfy extraordinarily high requirements with regard to the construction and material properties. The hot reaction mixture (approx. 850° C.) emerging from the cracking oven during the pyrolysis of hydrocarbons like naphtha, heavy petrol or even ethane has to be cooled quickly in the cracked gas coolers to prevent undesirable secondary reactions. The cracked gas coolers or the bundle of heat exchanger tubes serve as an evaporating boiler, in which high-pressure steam is produced by evaporating feed water supplied from the casing.

The cracked gas arriving at great speed from the cracking oven usually enters in the cracked gas cooler from below via a bonnet socket in which the transfer line is axially arranged and impacts on the bottom tube plate and after passing through the heat exchanger tubes of the cracked gas cooler is conveyed to an oil wash and further processing.

Despite the short residence times and high speeds of approx. 300 m/s the cracked gas already contains coke particles, which have a strong eroding affect at these speeds. As far as the construction of the apparatus is concerned, it is not practically feasible to charge evenly all internal tubes of the cracked gas cooler. consequently, the tubes provided in the central regions of the base plate as well as in the core zone region will erode more than those in the peripheral regions.

From EP-A-0 567 674 heat exchangers for the cooling a synthesis gas generated in a coal gasification plant is known, wherein the tube plate on the side of the gas inlet comprises individual parallelepiped-shaped nozzles, provided next to each other and abutting on the outer edges, while each nozzle has a tapered orifice, narrowing to a tubular cross-section protruding into a heat exchanger tube. This solution does not provide a gas-tight seal between the individual parallelepiped-shaped elements. In the cracked gas coolers of an olefin plant this would lead to coke formation in the intermediate spaces and destroy the materials. Furthermore, the ends of the nozzles used form a tear-off edge in the tube, which in the case of the flow velocities of approx. 300 m/s, used in cracked gas coolers, would cause strong whirling resulting in additional erosions.

Furthermore it is known to provide cooling tubes, installed in a reactor, with an erosion-retarding refractory coating (cf. U.S. Pat. No. 4 124 068), for the purposes of reducing the risk of failure of the tube and the ingress on cooling water into the surrounding. reaction mixture at elevated temperatures.

An attempt has been made to encounter the problem of a considerably stronger flow and load occurring in the core zone when compared with the edge zones by, inter alia, tapered baffles (cf. U.S. Pat. No. 35 52 487) or by diffusor-like deflection devices without baffles (German patent 21 60 372) in the bonnet socket.

Furthermore, to even out the flow-through the bonnet socket on the entry side and also to protect the tube plate from erosion it has been suggested to provide the bundle of heat exchanger tubes with baffles made of bars, bent into rings, wherein the rings are provided along the surface of a taper, the tip of which is directed toward the gas inlet (cf. EP 0 377 089 A1.).

This should slow down the coke particles carried away in the region of the core flow by the gas flowing at high velocity and deflect them partly radially outwards, so that they will no longer result in erosion damages on the tube plate or in the tube. On the other hand such baffles result in an undesired pressure difference and loss of yield due to the corresponding increase of the residence tile.

SUMMARY OF THE INVENTION

The invention follows another path, wherein an effective erosion protection is strived for by reinforcing the base plate. The erosions on the lower tube plate made periodic shut-downs of the cracked gas cooler necessary, while this has been remedied by restoring the base plates to the necessary wall thickness by build-up welding. This method is expensive and may not be satisfactory with regard to the resistance of the material applied by welding either. In the case of cracked gas coolers it makes it more difficult that the base plate works not only as an impact plate and as such is subjected to particular erosion, but simultaneously it has to be relatively thin to enable to achieve an as low as possible boundary surface temperature. This is desirable from the point of view of the construction of the apparatus as well as of advantage, . since the entering gases should be cooled as quickly as possible without causing undesirable secondary reactions.

To eliminate the disadvantages mentioned a bundle of heat exchanger tubes is suggested in accordance with claim 1. Advantageous embodiments are described in the sub-claims.

DETAILED DESCRIPTION OF THE INVENTION

Figure 1:
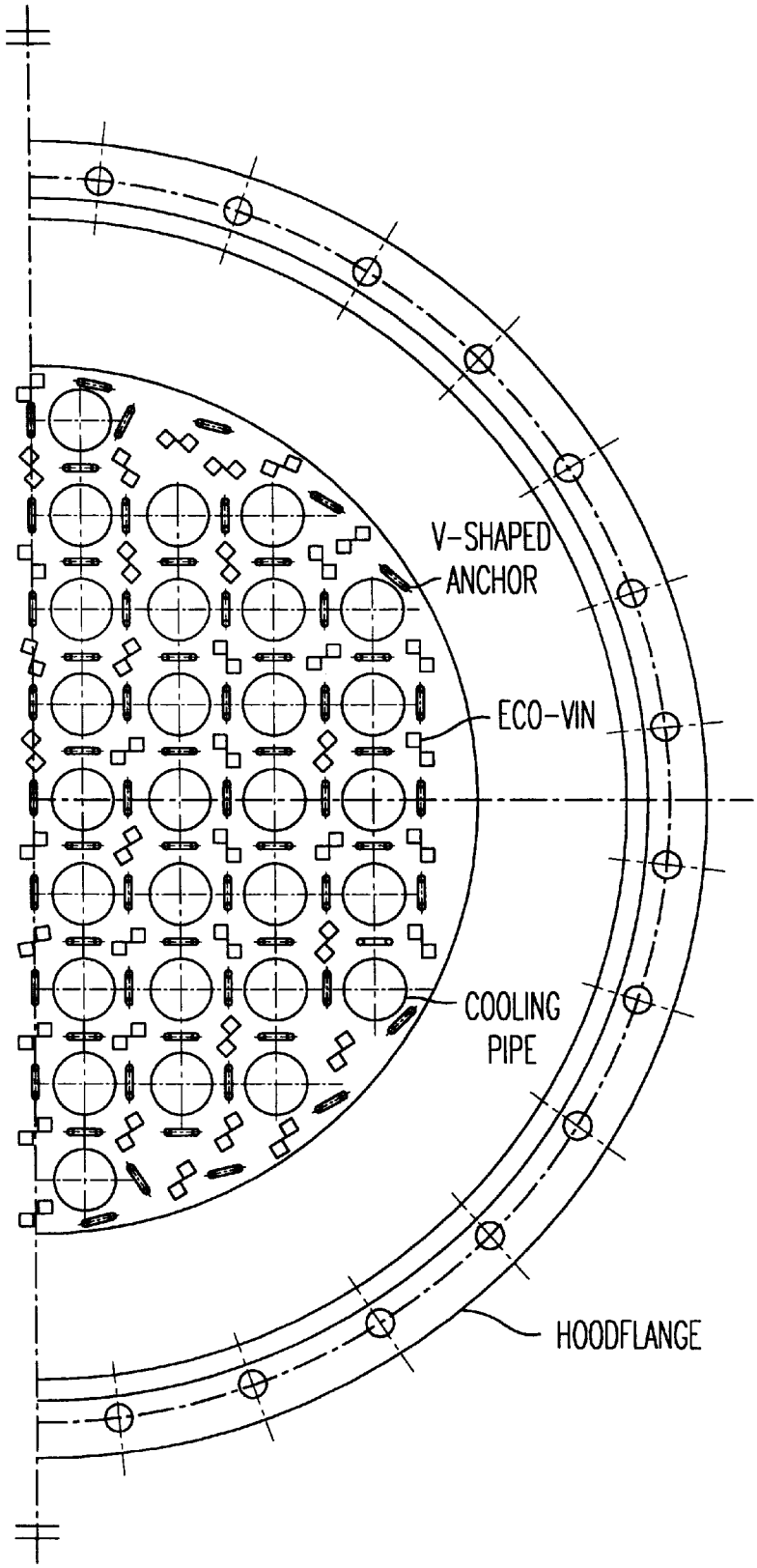
FIG. 1 shows a tube plate according to the invention in top view (viewed from below).

The coating is carried out, by means of a packing material having a thickness of 10 to 50, preferably 15 to 30 mm.

For a better adhesion of the packing material or of the coating, anchors, having preferably V-, T-, S- or Y-shapes, in particular having a diameter of approx. 5 mm or a sheet metal construction with a honeycomb structure, having preferably a height of 5 to 10 mm, are welded on the tube plate.

Such anchors are known in the furnace-technology as ECO-VINs for various coating strengths with linings welded on steel plates with masonry behind them, whereby for a better anchoring of the packing material the legs of the anchor can be bent to approx. 60° C. The anchors can be welded to the lower tube plate in a non-spread or spread state.

The coating with the packing material, made of a chemically bonded refractory erosion-resistant material, is applied either by hand or for larger areas by spraying and compacted manually, for example with a flat iron bar and hammer, or by electric tools.

As packing material, described occasionally as piling material, predominantly chemically setting materials, consisting of inorganic raw materials, are used. The setting takes place in the presence of air. A main raw material is, for example, conundrum. A typical composition of such a material is, for example, 85% by weight $Al_2O_3$, 7% by weight $SiO_2$, 0.3% by weight $Fe_2O_3$, 3.1% by weight MgO, 4.5% by weight $P_2O_5$ and 0.1% by weight alkalies (approximate values). The maximum grain size of the individual components should not exceed 4 mm. To process or produce the packing material this inorganic mixture is diluted with waiter and subsequently processed. It takes at least 24 hours after the application of the packing material for this to settle. This is followed by drying or baking. For this purpose hot air at a temperature of 150–200° C. is circulated for approx. 6 hours over the packing material and afterwards the temperature is increased to approx. 350° C. within 4 hours maximum. Depending on the operating temperature and the possible additives, like steel pins, the thermal conductivity of the set packing material or coating is between 1.5–3.5 W/mK. The abrasion of this coating is less than 8 $cm^3$ (according to ASTM C-704).

As packing material RESCO-CAST, for example, is suitable, a product of the RESCO Products Inc. Other commercially available suitable products, described as packing material, are PLIRAM Cyclone-Mix D by the Plibrico GmbH. The products mentioned are used, as is known from practice, for example for the internal coating of parts of a FCC (Fluid-Catalytic-Cracker) plant. Such parts of the plant will be cloated, in which the liquefied FCC catalyst moves at a speed of 20–30 m/s at a temperature of approx. 750° C. There is, however, no indication that the packing materials mentioned are suitable for the carrying out of the subject matter of the invention. Rather the reservations, that under special conditions the coating in a cracked gas cooler does not hold and falls into the cracked gas oven, leading to stoppages, had to be overcome, The basis of these reservations is that there was the danger that between the base plate and the coating and/or in the cracks of the coating, layers of growing coke will form similarly to linings with ceramic formed parts, which would finally blow off the coating.

For the purpose of improving the ability to withstand the temperature changes of the coating under the high requirements, steel pins or corrugated steel fibres (C-mix) could be added, inter alia, to the packing material, preferably in a proportion of 1–2% by weight.

In the case of a bundle of heat exchanger tubes of the type mentioned above with a bundle of tubes held between two base plates, the diameter of the transfer line from the cracking oven is usually increased to the diameter of the tube plate in the form of a bonnet socket.

In principle, in such a construction only the zone region in the centre of the tube plate needs to be coated. According to the invention, the erosiorn-protective coating can be applied to both new, not yet used base plates as well as to base plates, whose wall has been restored to the necessary thickness by build-up welding.

Furthermore, the invention concerns a method to coat a tube plate in a bundle of heat exchanger tubes. For this purpose the tube orifices are closed by plugs on the entry side tube plate. These plugs project from the tubes at least up to the thickness of the coating to be applied. Subsequently the packing material is applied. This can be carried out manually by spatula and trowel or by spraying. This is followed by mechanical compacting of the packing material by, for example, hammer blows transferred by a flat iron bar. After the setting of the packing material, usually at least after 24 hours, the plugs are removed and the packing material is possibly dried and baked.

The described packing materials are best suitable for coating base plates in bundles of heat exchanger tubes connected downstream of a thermal cracking installation.

The application of a coat to a base plate of a cracked gas cooler of an ethylene plans is described in the following in detail, wherein the procedure chosen for the application, the materials mentioned and the special case of application for a cracked gas cooler are to be understood not as limitations hut in the sense of an embodiment.

EMBODIMENT

Figure 2:
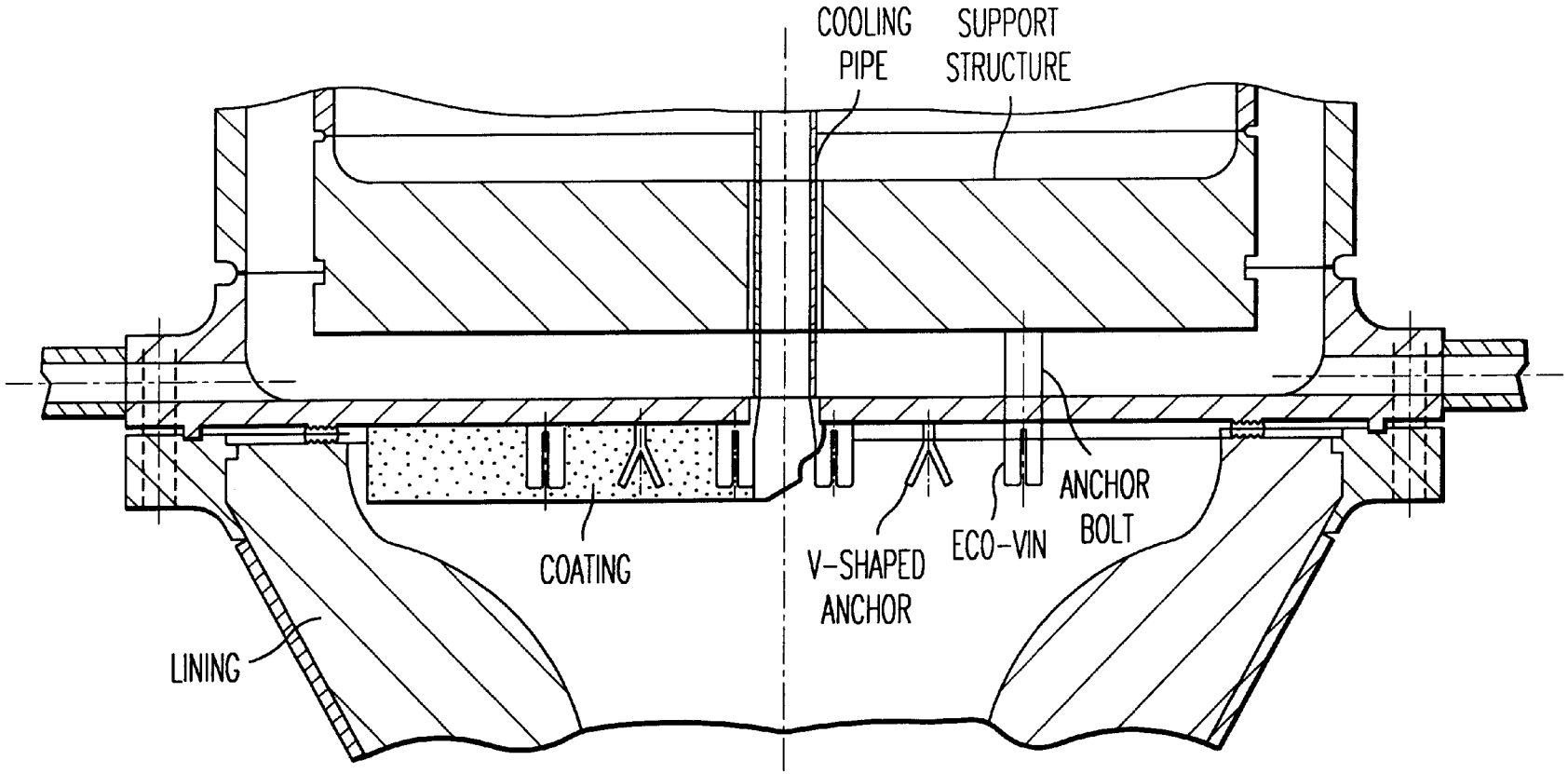
FIG. 2 shows a section across a cracked gas cooler having a coating according to the invention, in the region of the base plate.

V-anchors or ECO-VIN anchors, having the construction illustrated in FIGS. 1 and 2, made of authentic steel (1.4841), are welded. to a base plate. The internal tubes of the bundle of heat exchanger tubes are closed by tapered wooden plunges, so that the packing material is held both by the anchors and the plugs. The packing material, consisting of PLIRAM Cyclone-Mix D, is mixed with 2% by weight of corrugated steel fibres C-mix 25 (1.4841 material).

The application of the packing material is carried out manually with spatula and trowel. Following this the packing material applied is compacted section by section by hammer blows transferred by a flat iron bar to result in a cavity-free coating. After a setting time of approx. 25 hours at normal ambient temperature the tapered wooden plugs are removed.

The drying of the packing material and the subsequent baking is carried out according to a specified temperature graph following the manufacture's instructions.

By applying the coating, previously damaged base plates can be protected from further erosions The base plates coated according to the invention are subjected also to erosion by the coke particles. In comparison with the unprotected metallic material of the base plate, the erosion of base plates coated according to the invention is clearly slower, so that the availability of the corresponding plant parts is improved. Incidentally, when worn, a removal and renewed application of the coating according to the invention is possible.

By virtue of the good heat. insulating property of the coating the problem of the boundary temperature, mentioned in the introduction, is also diminished. This results in the further advantage that the metallic base plate does not need to be that thin, but can be made thicker. Due to the constructive stabilising resulting from this, the anchor bolts necessary for the stabilisation can be dispensed with, at least partly.

What is claimed is:

1. A method of providing a gap-free erosion-protective from coke coating for a tube plate in a bundle of heat exchanger tubes connected downstream of a thermal cracking installation by closing the heat exchanger tubes, held in the tube plate, with plugs, which plugs after the closing are at least at the height of a thickness of a coating to be applied, applying a chemically setting erosion-protective from coke packing material, mechanically compacting the packing material, letting the packing material set, removing the plugs, and possibly baking the packing material.

2. A method according to claim 1, characterised in that before the application of the packing material, a honeycomb-shaped sheet-metal construction or anchors are welded to the tube plate.

3. A bundle of heat exchanger tubes connected downstream of a thermal cracking installation with a bundle of heat exchanger tubes held between two tube plates and an erosion-resistant refractory coating of the tube plate on the entry side on that side where the gas is flowing from while leaving the orifices open, which can be produced by a method according to claim 1.

4. A bundle of heat exchanger tubes according to claim 3, characterised in that the coating of the set packing material has a thickness of 10–50.

5. A bundle of heat exchanger tubes according to claim 3, characterised in that for a better adhesion of the packing material to the tube plate a honeycomb-shaped sheet metal construction, or anchors, are welded onto it.

6. A bundle of heat exchanger tubes according to claim 3, characterised in that corrugated steel fibres are included in the packing material.

7. A bundle of heat exchanger tubes according to claim 3, characterised by an entry chamber, which is increased from the diameter of the transfer line from the cracking plant to the diameter of the tube plate on the entry side.

8. A bundle of heat exchanger tubes according to claim 4, wherein the thickness is 15–30 mm.

9. A bundle of heat exchanger tubes according to claim 5, wherein the anchors have V-, T-, S- or Y-shapes.

* * * * *

UNITED STATES PATENT AND TRADEMARK OFFICE

CERTIFICATE OF CORRECTION

PATENT NO. : 6,155,337
DATED : December 5, 2000
INVENTOR(S) : Bernhard Rosengarten, et al.

It is certified that error appears in the above-identified patent and that said Letters Patent is hereby corrected as shown below:

Title page,
Item [22], the PCT International filing date is listed incorrectly. It should read as follows:

-- [22] PCT Filed: Sep. 14, 1996 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*